US008186701B2

(12) United States Patent
Sim et al.

(10) Patent No.: US 8,186,701 B2
(45) Date of Patent: May 29, 2012

(54) METHOD AND APPARATUS FOR TRANSFERRING A WHEELCHAIR BOUND PERSON

(75) Inventors: Tian Soon Sim, Nouvelle Park (SG); Choon Mui Loh, Nouvelle Park (SG)

(73) Assignee: Nanyang Polytechnic, Singapore (SG)

( * ) Notice: Subject to any disclaimer, the term of this patent is extended or adjusted under 35 U.S.C. 154(b) by 143 days.

(21) Appl. No.: 12/598,924

(22) PCT Filed: May 6, 2008

(86) PCT No.: PCT/SG2008/000165

§ 371 (c)(1), (2), (4) Date: Nov. 4, 2009

(87) PCT Pub. No.: WO2008/136777

PCT Pub. Date: Nov. 13, 2008

(65) Prior Publication Data

US 2010/0133779 A1 Jun. 3, 2010

(30) Foreign Application Priority Data

May 8, 2007 (AU) ..... 2007902422

(51) Int. Cl.
*A61G 7/08* (2006.01)

(52) U.S. Cl. ..... 280/304.1; 5/81.1 HS

(58) Field of Classification Search ..... 280/304.1; 5/81.1 HS, 81.1 R

See application file for complete search history.

(56) References Cited

U.S. PATENT DOCUMENTS

| | | | | |
|---|---|---|---|---|
| 4,155,588 | A * | 5/1979 | Danziger et al. | 297/115 |
| 5,419,571 | A * | 5/1995 | Vaughan | 280/250.1 |
| 6,312,051 | B1 * | 11/2001 | Adams | 297/228.11 |
| 7,305,726 | B2 * | 12/2007 | Augustine et al. | 5/81.1 HS |
| 2004/0080137 | A1 | 4/2004 | Kuntz | |
| 2006/0103182 | A1 | 5/2006 | Augustine et al. | |

OTHER PUBLICATIONS

Derwent Abstract Accession No. 2003-117579/11, JP 2002-360639 A (IURA KK) Dec. 17, 2002 abstract.

* cited by examiner

*Primary Examiner* — Tony Winner
(74) *Attorney, Agent, or Firm* — Pyprus Pte Ltd

(57) ABSTRACT

The present invention provides a modular lateral transfer assembly (MLTA) adaptable to a wheelchair for easily transferring a wheelchair bound person, and a modular wheel assembly (MWA) adaptable to a wheelchair for easily transferring a wheelchair bound person laterally. The present invention also provides a wheelchair integrating the MLTA and MWA either individually or in combination.

26 Claims, 12 Drawing Sheets

METHOD AND APPARATUS FOR TRANSFERRING A WHEELCHAIR BOUND PERSON

FIELD OF THE INVENTION

The present invention generally relates to wheelchairs, and more particularly to methods and apparatuses that can be integrated into a wheelchair so that a wheelchair bound person can be easily transferred.

BACKGROUND OF THE INVENTION

Transferring from a wheelchair to another place, such as car, bed, bath, toilet, furniture, or other places, is a problem for both wheelchair riders and their helpers. Present wheelchair riders can rely on separate transfer apparatus such as lifters and transfer boards to aid the transfer. The lifters are not only costly but also lack of portability, whereas the transfer boards are economical but require extreme care and skills in using. Some riders choose to perform these transfers independently using their upper limbs, while others request assistance from helpers. Depending on a rider's condition, the recommended transferring technique can involve use of transferring aids such as a lifter, belt, transfer board, easy slide, turntable, and draw sheet-slow process. The problem in performing these transfers manually, without the aid of apparatus, is that the transfers may lead to repetitive strain injuries as a result of prolong actions that place strain on a body. Other causes of physical injuries to both helpers and wheelchair riders may include a traumatic accident, or a series of small accidents because of incorrect transferring procedures or techniques.

Therefore, there is an existing need for methods and apparatuses that can help the transfer of a wheelchair bound person.

SUMMARY OF THE INVENTION

One embodiment of the present invention provides a modular lateral transfer assembly (MLTA) adaptable to a wheelchair for easily transferring a wheelchair bound person. The MLTA comprises a pivotal shaft being secured onto a frame of the wheelchair, thereby providing physical support for the MLTA, a main slide board for providing a transfer plane, one or more sleeve units disposed underneath of the main slide board for securing the board onto the pivotal shaft, and a location hole assembly disposed at one end of the main slide board; thereby when the main slide board via the location hole assembly is secured to the frame of the wheelchair, the wheelchair bound person is transferred via the transfer plane.

In another embodiment of the MLTA, the main slide board has a plurality of through holes for lightening the board.

In another embodiment of the MLTA, it further comprises a secondary slide board, wherein the main slide board has one end for receiving the secondary slide board so that when the secondary slide board is pulled out, it forms an elongated transfer plane.

In another embodiment of the MLTA, each sleeve unit has a channel allowing the sleeve unit to rotatably accommodate the frame and a threaded hole for accommodating a fastener for securing the sleeve unit onto the main slide board.

In another embodiment of the MLTA, the location hole assembly has an oversized cavity for receiving a quick-release locking means disposed onto the opposite side of the frame, so that the main slide board is ready for transfer.

In another embodiment of the MLTA, the main slide board comprises one or more casing disposed onto its top surface for receiving one or more rollers, easing the transfer process.

In another embodiment of the MLTA, the main slide board comprises a plurality of casings disposed onto its top surface for receiving a plurality of rolling balls, easing the transfer process.

In another embodiment of the MLTA, the main slide board has a one-piece configuration. In another embodiment of the MLTA the main slide board has a two-piece configuration.

Another embodiment of the present invention provides a modular wheel assembly (MWA) adaptable to a wheelchair for easily transferring a wheelchair bound person laterally. The MWA comprises a linear guide assembly being disposed onto a frame of the wheelchair, a slidable wheel assembly coupled with the linear guide assembly, where the slidable wheel assembly slides along the linear guide assembly from a front position and a rear position, and a quick-release locator working together with the linear guide assembly to secure and lock the slidable wheel assembly at a desired position, whereby when the slidable wheel assembly is moved away from the front to the rear, a lateral transfer is allowed.

In another embodiment of the MWA, the slidable wheel assembly comprises a wheel, a wheel axle for supporting the wheel, a cover plate, a wheel lock/brake mounted on the cover plate for locking the wheel when it is not in motion, a quick-release locator mounted on the cover plate for securing the slidable wheel assembly at a desired position, and a hand rim for allowing hand pushes.

In another embodiment of the MWA, the linear guide assembly comprises a backplate, a pair of linear guide rods, a pair of linear guide holding blocks securely coupled onto the backplate for holding the two ends of the linear guide rods, a linear slide unit slidably disposed on the linear guide rods so that the linear slide unit moves between the linear guide holding blocks, wherein the linear slide unit is coupled with the slidable wheel assembly so that it moves the slidable wheel assembly, and a bracket securely coupled with the backplate for attaching the linear guide assembly to the frame.

In another embodiment of the MWA, the backplate has a plurality of holes including home location holes, alternate home location holes and transfer location holes for stopping and securing the motion of the linear slide unit.

In another embodiment of the MWA the linear guide assembly further comprises a cover plate for covering the linear guide assembly.

In another embodiment of the MWA, the linear slide unit is preloaded with rolling elements for easy sliding.

In another embodiment of the MWA, the linear guide rods have a feature selected from the group consisting of spline, circular shaft, polygonal shaft, and track rail.

In another embodiment of the MWA, the linear guide rod holding block is configured to have a pair of holes for receiving the linear guide rods, a pair of holes for fastening the block onto the backplate, and a hole for receiving a fastener for locking the linear guide rods.

In another embodiment of the MWA, the bracket is configured to have a threaded hole and a through hole for cooperatively holding the backplate onto the frame, and a threaded hole for securing the bracket to the backplate.

Another embodiment of the present invention provides a wheelchair for easily transferring a wheelchair bound person. The wheelchair comprises a modular lateral transfer assembly (MLTA), where the MLTA comprises a pivotal shaft being secured onto a frame of the wheelchair, thereby providing physical support for the MLTA, a main slide board for providing a transfer plane, one or more sleeve units disposed underneath of the main slide board for securing the board onto the pivotal shaft, and a location hole assembly disposed at one end of the main slide board; thereby when the main slide board via the location hole assembly is secured to the frame of the wheelchair, the wheelchair bound person is transferred via the transfer plane, and a locking means for locking the main slide board when it is being used for transfer.

In another embodiment of the wheelchair, the quick-release locking means is a spring loaded plunger.

In another embodiment of the wheelchair, it further comprises a seat cover disposed on top of a sling seat and detachable from the sling seat.

Another embodiment of the present invention provides a wheelchair for easily transferring a wheelchair bound person. The wheelchair comprises a frame, and a modular wheel assembly (MWA), wherein the MWA comprises a linear guide assembly being disposed onto a frame of the wheelchair, a slidable wheel assembly coupled with the linear guide assembly, where the slidable wheel assembly slides along the linear guide assembly from a front position and a rear position, and a quick-release locator working together with the linear guide assembly to secure and lock the slidable wheel assembly at a desired position, whereby when the slidable wheel assembly is moved away from the front to the rear, a lateral transfer is allowed.

In another embodiment of the wheelchair, it further comprises a modular lateral transfer assembly (MLTA), where the MLTA comprises a pivotal shaft being secured onto a frame of the wheelchair, thereby providing physical support for the MLTA, a main slide board for providing a transfer plane, one or more sleeve units disposed underneath of the main slide board for securing the board onto the pivotal shaft, and a location hole assembly disposed at one end of the main slide board; thereby when the main slide board via the location hole assembly is secured to the frame of the wheelchair, the wheelchair bound person is transferred via the transfer plane.

In another embodiment of the wheelchair, it further comprises a locking means for quick-release locking the main slide board when it is being used for transfer.

In another embodiment of the wheelchair, the quick-release locking means is a spring loaded plunger.

In another embodiment of the wheelchair, it further comprises a seat cover disposed on top of a sling seat and detachable from the sling seat.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

One embodiment of the present invention provides a transfer apparatus that is integrated with a wheelchair for allowing a wheelchair bound person to be transferred easily. In brief, the transfer apparatus comprises a modular wheel assembly (MWA) and a modular lateral-transfer assembly (MLTA). Depending on a user's choice, MWA and MLTA can be fitted on to a wheelchair for either a left- or a right-sided transfer. They can also be fitted on both sides of a wheelchair. In certain embodiments, MWA or MLTA can be incorporated separately to a wheelchair to meet a singular need. For example, only MWA will be incorporated in wheelchairs that use other transfer apparatus. The MWA can be linearly displaced to the rear freeing up sufficient space for a lateral transfer of a wheelchair rider. The MLTA can be deployed modularly to reach a targeted place or seat to provide a smooth and reliable transfer of the rider from the wheelchair. It is to be noted that the wheelchair with integrated MWA and MLTA does not need to be assembled de novo. Existing standard wheelchair users can remove one wheel with its associated components so that the remaining frame and wheel are ready for attachment of MWA and MLTA, a retrofitting option where the MWA and MLTA can be marketed and fitted separately.

Figure 1:
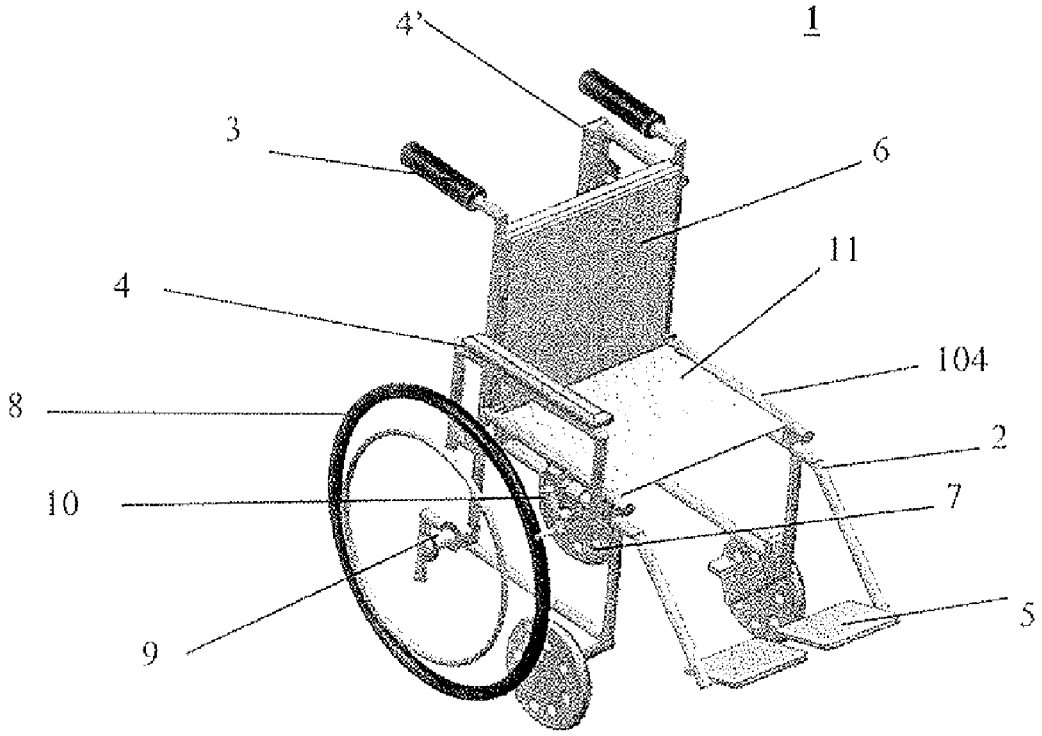
FIG. 1 shows an isometric perspective view of a wheelchair in accordance with one embodiment of the present invention, where partial components of the wheelchair are shown.

Now referring to FIG. 1, there is provided an isometric perspective view of a wheelchair in accordance with one embodiment of the present invention, where partial components of the wheelchair are shown for the clarity. As shown in FIG. 1, the wheelchair 1 has a configuration for a left-sided transfer, comprising a frame 2 for providing supports for other components (e.g., wheels); a pair of push handles 3; a pair of armrests 4, 4' where one of them 4' is a swivel armrest that can be lifted; a pair of footplates 5; a backrest 6; an optional castor 7; a fixed wheel 8; an axle 9; a wheel lock/brake 10; and a sling seat 11. The frame 2 is usually foldable for stowage. The push handles 3, armrests 4, 4', footplates 5, axle 9, and wheel lock/brake 10 are coupled to the frame 2 for support. The wheel 8 is coupled to the axle 9 and can be locked into a position by the wheel lock/brake 10. The sling seat 11 is employed for supporting a wheelchair bound person.

Figure 2:
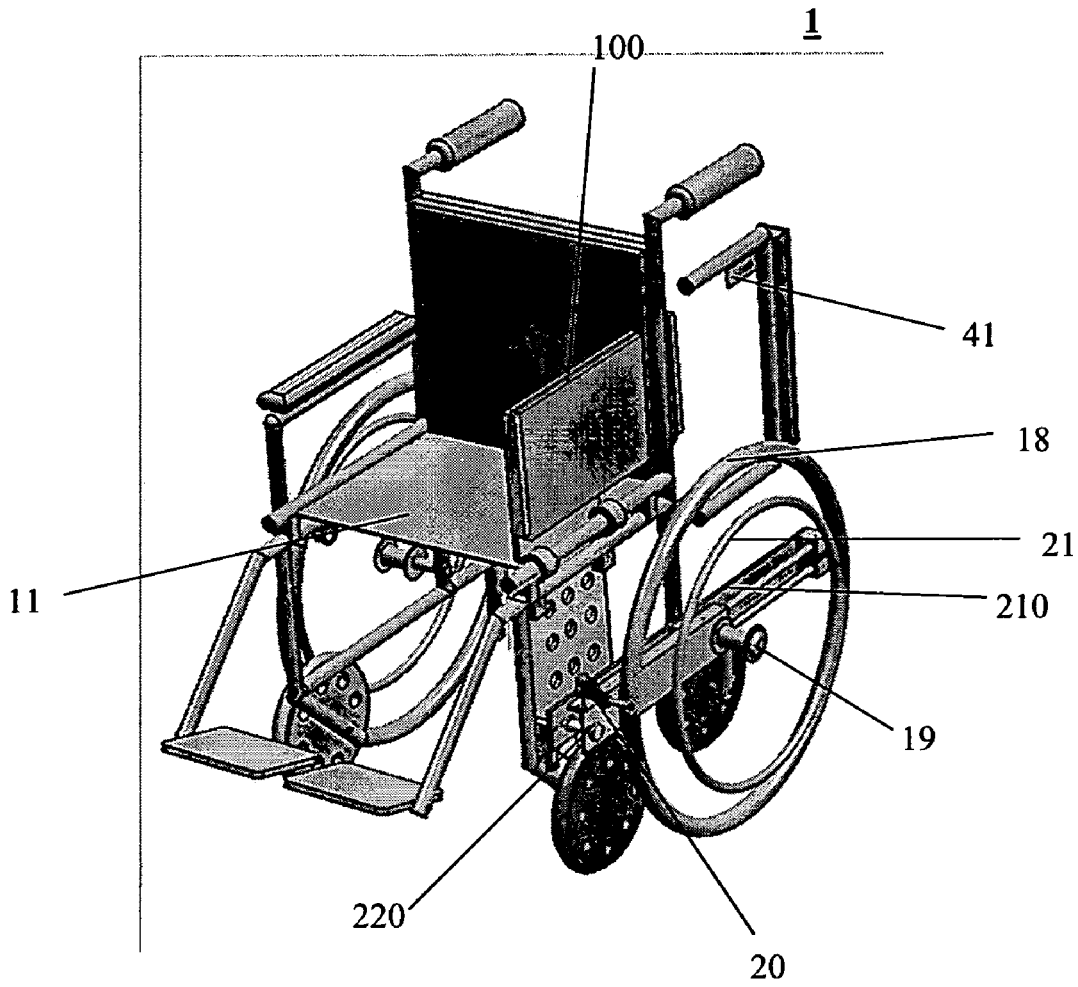
FIG. 2 shows an isometric perspective view of a wheelchair in accordance with one embodiment of the present invention, where most components of the wheelchair are shown.

Now referring to FIG. 2, there is provided an isometric perspective view of a wheelchair in accordance with one embodiment of the present invention, where most components of the wheelchair are shown. The components described above in reference to FIG. 1 will not be described further. As shown in FIG. 2, the wheelchair 1 has a configuration for a left-sided transfer, comprising a modular lateral transfer assembly (MLTA) 100 described in detail hereinbelow; a modular wheel assembly (MWA) 200 including a linear guide assembly 210, a quick-release locator 220 shown herein, and a slidable wheel assembly with a wheel 18, a wheel axle 19, a wheel lock/brake 20, and a hand rim 21 for allowing hand pushes. The MLTA 100 is coupled with the frame 2 for providing the means to allow the wheelchair bound person to be laterally transferred from or into the wheelchair. The MLTA 100 is held in its upright position by a "C" channel 41 disposed onto the swivel armrest 4'. The MWA 200 is coupled to the frame 2 for allowing the slidable wheel assembly to slide between a front position and a rear position, so that the slidable wheel assembly of the MWA 200 can be moved away from the front to the rear when a lateral transfer is needed. FIG. 2 shows that the swivel armrest is lifted upwards with the MLTA 100 in the stowed upright position, and the MWA is in the initial "home" position.

Figure 3:
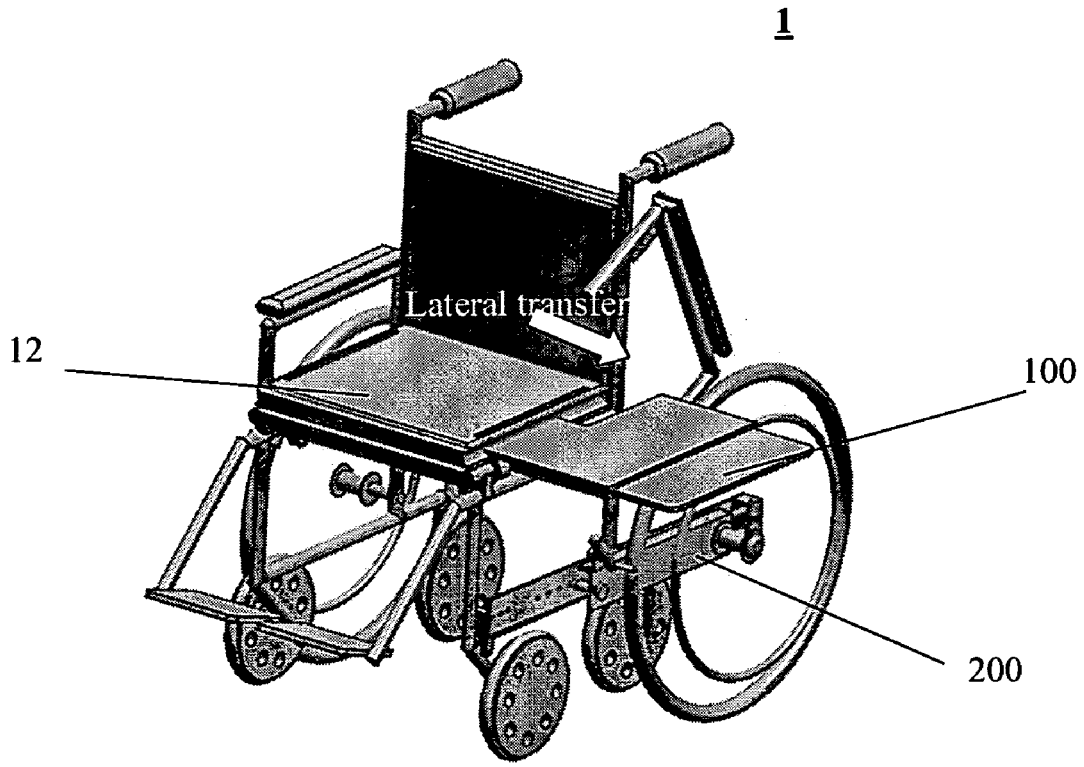
FIG. 3 shows an isometric perspective view of a wheelchair in accordance with one embodiment of the present invention, where the MLTA 100 is in a fully deployed horizontal position, and the MWA 200 is in the extended transfer position.
Figure 4:
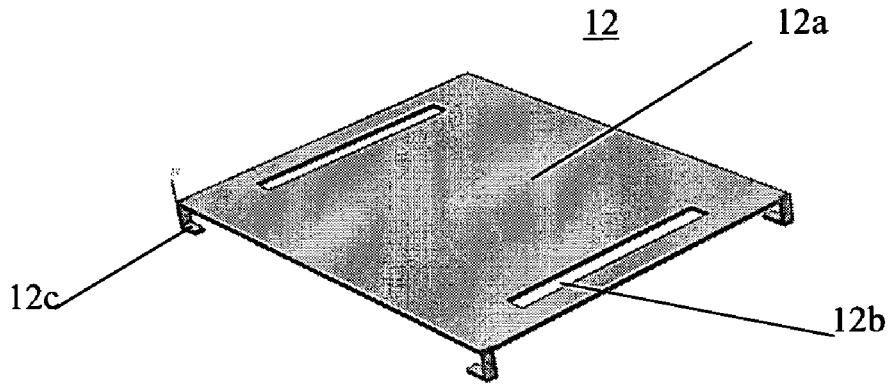
FIG. 4 shows an isometric perspective view of the detachable seat cover 12 in accordance with one embodiment of the present invention.

Now referring to FIG. 3, there is provided an isometric perspective view of a wheelchair in accordance with one embodiment of the present invention, where the MLTA 100 is in a fully deployed horizontal position, and the MWA is in the extended transfer position. As shown in FIG. 3, the wheelchair is ready for lateral transfer operation. The wheelchair further comprises an optional seat cover 12 that is disposed on top of the sling seat 11 and detachable from the sling seat 11. In one configuration of the detachable seat cover 12 as shown in FIG. 4, it has a plane 12*a* for covering the sling seat 11, a pair of gripping holes 12*b* located at two ends of the plane, and a plurality of easy hooks 12*c* positioned at four corners of the plane for securing the detachable seat cover onto the sling seat.

Figure 5:
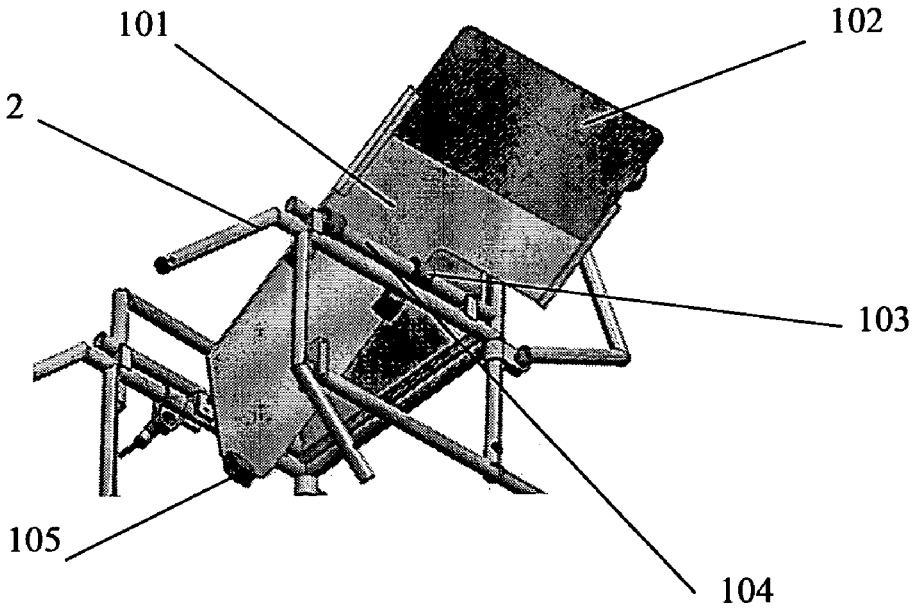
FIG. 5 shows an isometric perspective underside view of the MLTA 100 in accordance with one embodiment of the present invention, where the MLTA is in a tilted position.
Figure 6:
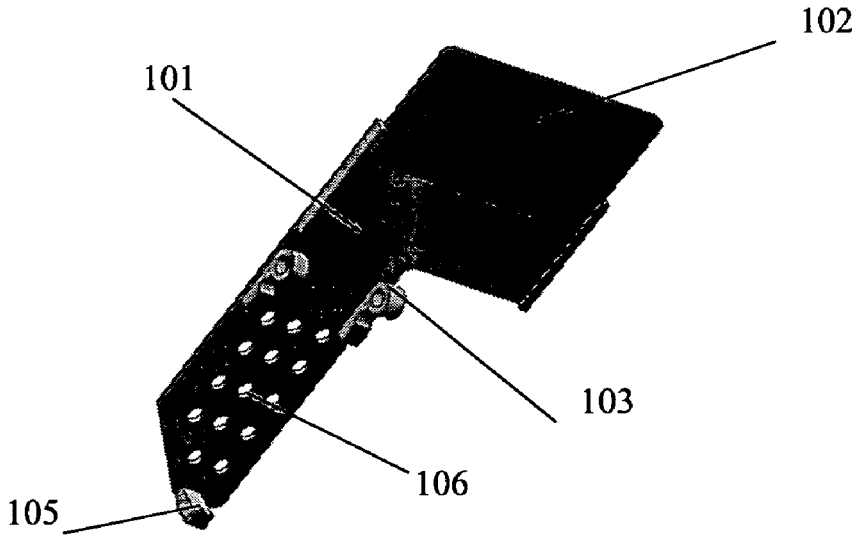
FIG. 6 shows an isometric perspective underside view of the MLTA 100 in accordance with one embodiment of the present invention.
Figure 7:
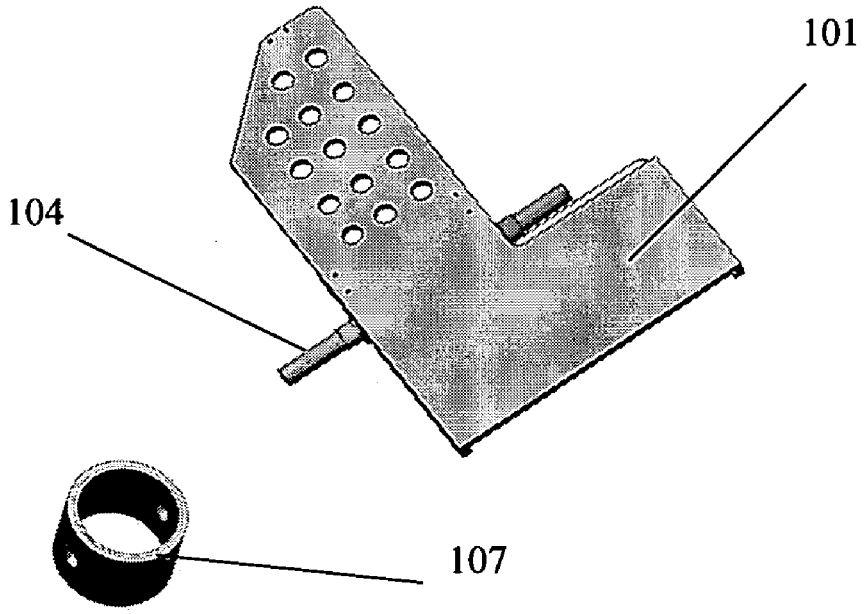
FIG. 7 shows an isometric perspective view of the MLTA 100 in accordance with one embodiment of the present invention, where a bushing 107 is included.

Now referring to FIG. 5, there is provided an isometric perspective underside view of the MLTA 100 in accordance with one embodiment of the present invention. As shown in FIG. 5, the MLTA is assembled into the wheelchair and in a tilted position with the sling seat being removed for visual clarity. The MLTA 100 comprises a main slide board 101, a secondary slide board 102, one or more sleeve units 103, a pivotal shaft 104, and a location hole assembly 105. The main slide board 101 has one end for receiving the secondary slide board 102 so that the secondary slide board 102 can be pulled out in a telescopic way, thereby when lateral transfer is needed, the secondary slide board 102 can be pulled out from the main slide board 101 to form an elongated transfer plane. The sleeve units 103 are disposed underneath of the main slide board 101 for securing the boards onto the pivotal shaft 104 which in turn is secured onto the frame 2. As shown in FIG. 6, another embodiment of the present invention provides a plurality of through holes 106 in the main slide board 101 for lightening the board. One end of the main slide board 101 has a cut corner configuration for making space for front castor wheel. FIG. 7 shows an isometric perspective view of the MLTA 100 in accordance with one embodiment of the present invention, where a bushing 107 is included. The bushing 107 secures the main slide board 101 into a desired axial position onto the pivotal shaft 104 by using a standard screw.

Figure 8:
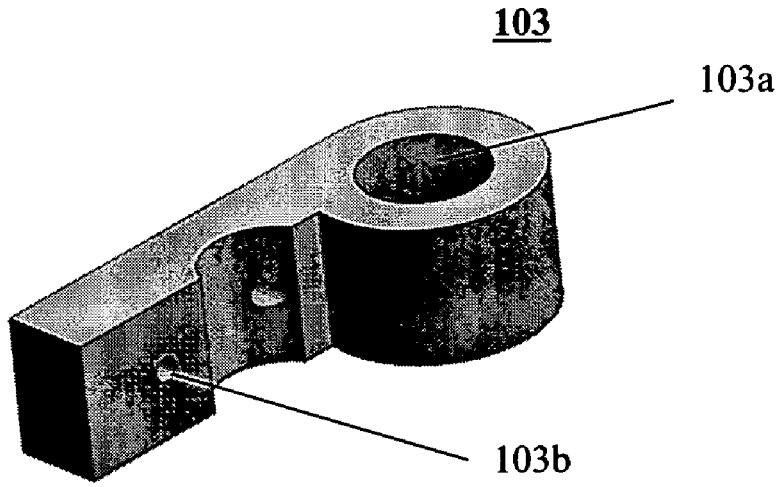
FIG. 8 shows an isometric perspective view of the sleeve unit 103 in accordance with one embodiment of the present invention.

FIG. 8 shows one configuration of the sleeve unit 103 in accordance with one embodiment of the present invention, where the sleeve unit 103 has a channel 103*a* allowing the sleeve unit 103 to rotatably accommodate the frame 2 and a threaded hole 103*b* for accommodating a fastener for securing the sleeve unit 103 onto the main slide board 101. The rotational smoothness of the main slide board 101 can be enhanced by using of either suitable lubrication or rolling elements in between the interface of channel 103*a* and the shaft 104. The main slide board is movable along the pivot shaft 104 for fine adjustment. Its relative position is lockable by the bushing 107.

Figure 9:
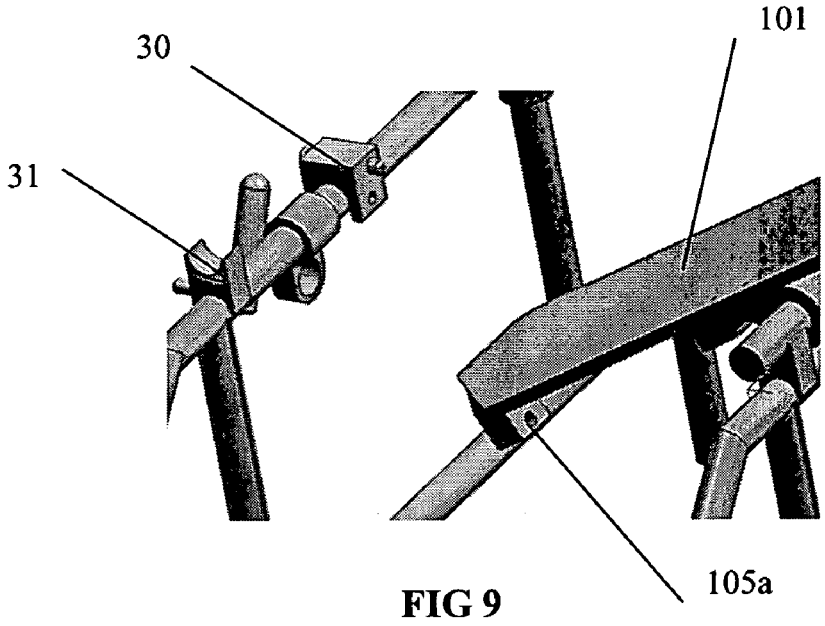
FIG. 9 shows an isometric perspective view of the main slide board 101 and its locking mechanism in accordance with one embodiment of the present invention.
Figure 10:
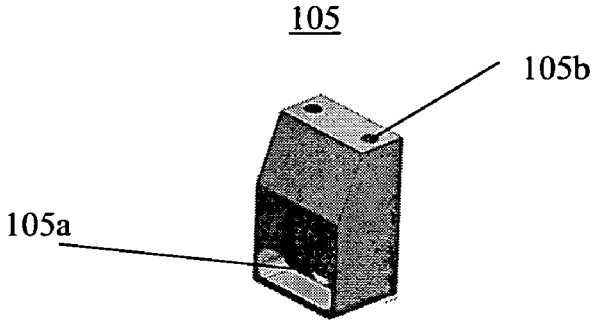
FIG. 10 shows an isometric perspective view of the location hole assembly 105 in accordance with one embodiment of the present invention.
Figure 11:
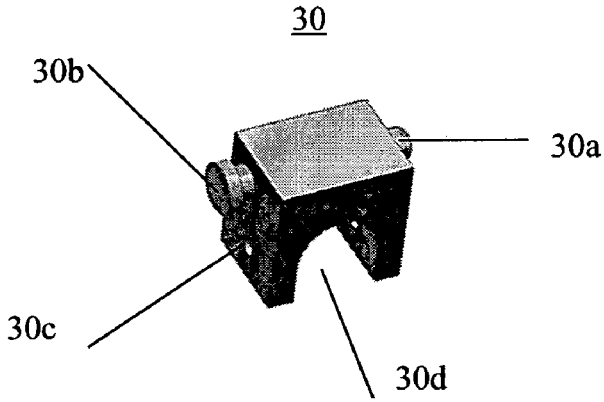
FIG. 11 shows an isometric perspective view of the spring loaded plunger 30 in accordance with one embodiment of the present invention.

Now referring to FIG. 9, there is provided an isometric perspective view of the main slide board 101 and its quick-release locking mechanism in accordance with one embodiment of the present invention. The quick-release locking mechanism includes the location hole assembly 105 and a spring loaded plunger 30. The location hole assembly 105 has an oversized hole 105*a* which can be circular and rectangular cavity for receiving the spring loaded plunger 30 disposed onto the opposite side of the frame 2, so that the main slide board 101 is ready for transfer. This clearance derived from the diameter difference between the plunger 30*a* and the oversized hole 105*a*, is needed to accommodate small initial height difference found between the targeted place and the fully deployed slide boards. In one embodiment as shown in FIG. 10, the location hole assembly 105 has a block configuration with a pair of threaded holes 105*b* formed at one end for securing the assembly onto the bottom surface of the main slide board 101, and the oversized hole 105*a* formed at the other end. One embodiment of the spring loaded plunger is shown in FIG. 11, where the spring loaded plunger 30 has configured to include a cavity 30*d* for fitting the spring loaded plunger onto the frame 2, a pair of holes 30*c* for fastening, a plunger 30*a* for inserting into the oversized hole 105*a*, and a pull knob 30*b* for pulling the plunger 30*a*. In addition, FIG. 9 shows a recess clamp 31 for engaging and locking the sling seat 11 onto the frame 2.

Figure 12:
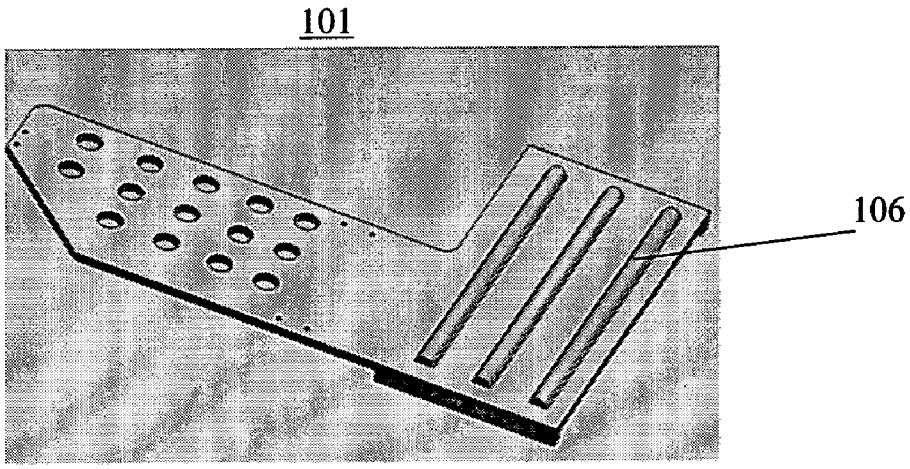
FIG. 12 shows an isometric perspective view of an optional roller assembly disposed onto the main slide board in accordance with one embodiment of the present invention.
Figure 13:
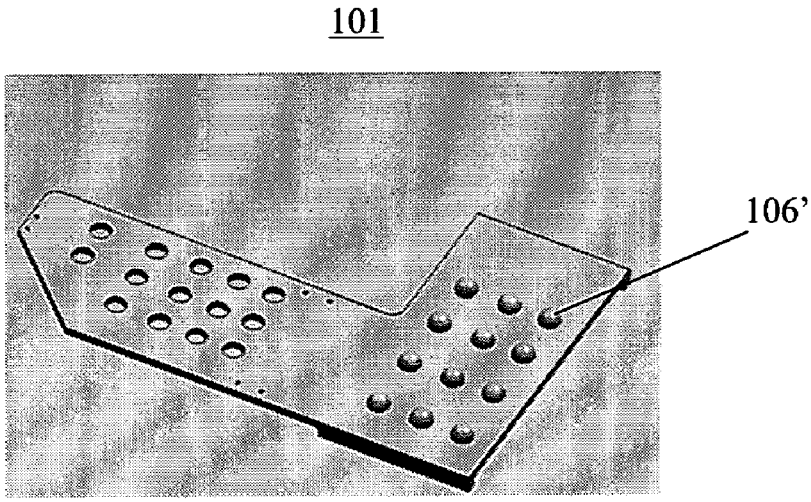
FIG. 13 shows an isometric perspective view of an optional ball transfer units disposed onto the main slide board in accordance with one embodiment of the present invention.

Now referring to FIGS. 12 and 13, there are provided two examples of optional transfer means that can be disposed onto the top surface of the main slide board for easing the transfer process. The transfer means shown in FIG. 12 comprises one or more rollers 106 that sit nicely on a metallic casing. The transfer means shown in FIG. 13 comprises a plurality of rolling balls 106' that sit snugly on metallic casings.

Figure 14:
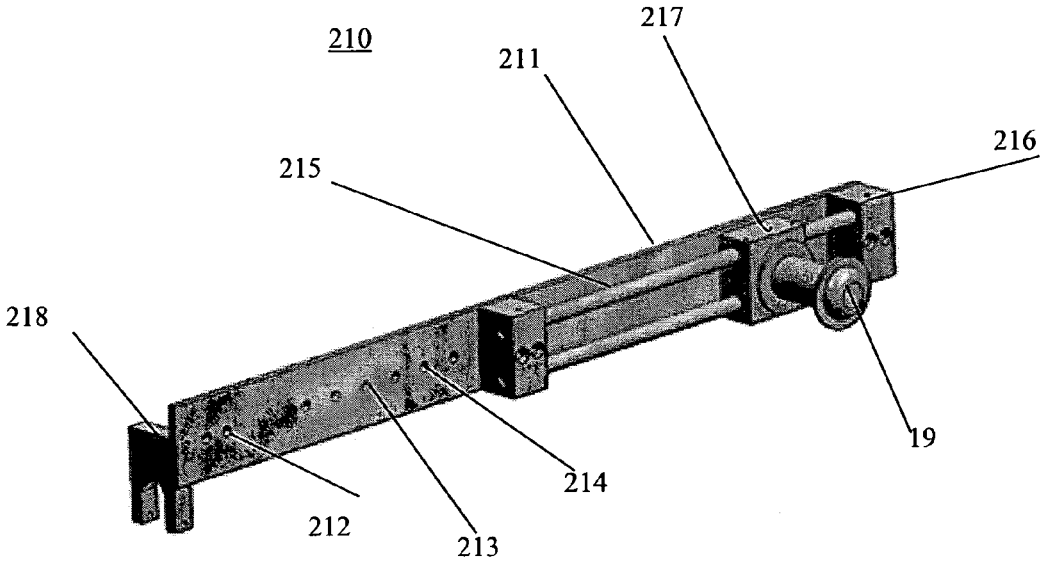
FIG. 14 shows an isometric perspective view of the linear guide assembly 210 in accordance with one embodiment of the present invention.
Figure 15:
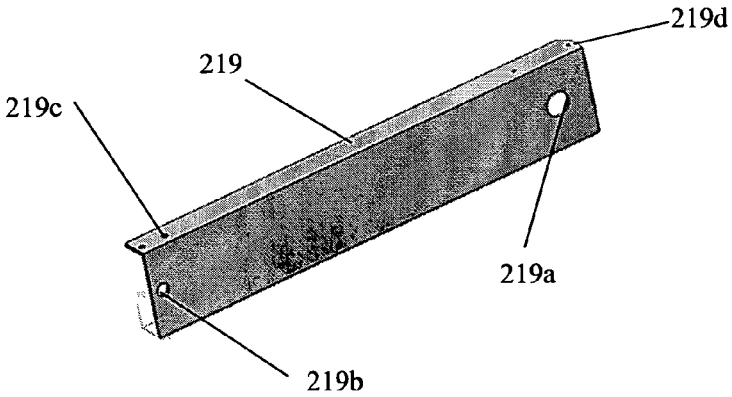
FIG. 15 shows an isometric perspective view of the coverplate of the linear guide assembly 210 in accordance with one embodiment of the present invention.

Now referring to FIG. 14, there is provided shows an isometric perspective view of the linear guide assembly 210 in accordance with one embodiment of the present invention. The linear guide assembly 210 comprises a backplate 211, a pair of linear guide rods 215, a pair of linear guide holding blocks 216, a linear slide unit 217, and a bracket 218. The backplate 211 has a plurality of holes including home location holes 212, alternate home location holes 213 and transfer location holes 214 for stopping and securing the motion of the linear slide unit 217. The linear guide holding blocks 216 are securely coupled onto the backplate 211 for holding the linear guide rods 215, where the linear slide unit 217 is slidably disposed on the linear guide rods 215 so that the linear slide unit 217 moves between the linear guide holding blocks 216. The linear slide unit 217 is also coupled with the wheel axle 19 so that it moves the wheels 18 back/forward. The bracket 218 is securely coupled with the backplate 211 for attaching the linear guide assembly to the frame 2. As shown in FIG. 15, the linear guide assembly 210 also comprises a cover plate 219 for covering the linear guides, where the cover plate 219 is configured to have a through hole 219*a* for mounting of the slidable wheel assembly, a through hole 219*b* for mounting the plunger/quick-release locator 220, fastening holes 219*c* for securing the bracket that holds the wheel lock/brake 20, and a fastening hole 219*d* for securing the cover plate to the linear slide unit 217. The linear slide unit 217 can be preloaded with rolling elements such as rollers, balls or the likes. The linear guide rods 215 can have feature such as spline, circular shaft, polygonal shaft, track rail or the likes. The sliding contact surfaces can be suitably lubricated to facilitate smooth action.

Figure 16:
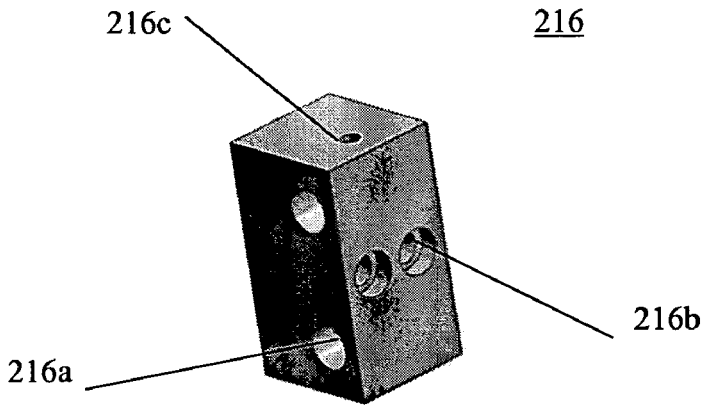
FIG. 16 shows an isometric perspective view of the linear guide rod holding block 216 in accordance with one embodiment of the present invention.

FIG. 16 shows an isometric perspective view of the linear guide rod holding block 216 in accordance with one embodiment of the present invention. The linear guide rod holding block 216 is configured to have a pair of holes 216*a* for receiving the linear guide rods 215, a pair of holes 216*b* for fastening the block onto the backplate 211, and a hole 216*c* for receiving a fastener for locking the linear guide rod 215.

Figure 17:
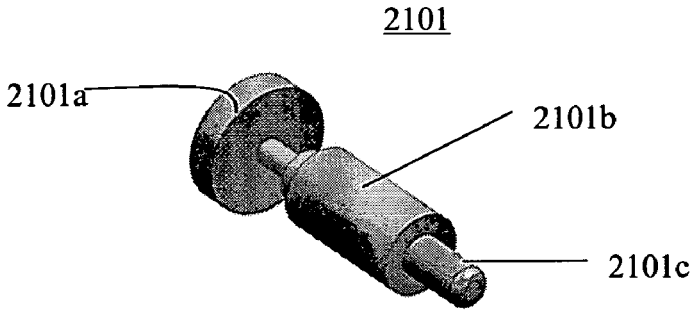
FIG. 17 shows an isometric perspective view of a quick-release locator for being attached to the coverplate of the linear guide assembly in accordance with one embodiment of the present invention.

FIG. 17 shows an isometric perspective view of a quick-release locator 220 for being attached to the cover plate 219 of the linear guide assembly in accordance with one embodiment of the present invention. In this case the quick-release locator 220 is a spring loaded plunger 2101, configured to have a pull knob 2101*a*, a housing for a spring 2101*b* and a plunger 2101*c*.

Figure 18:
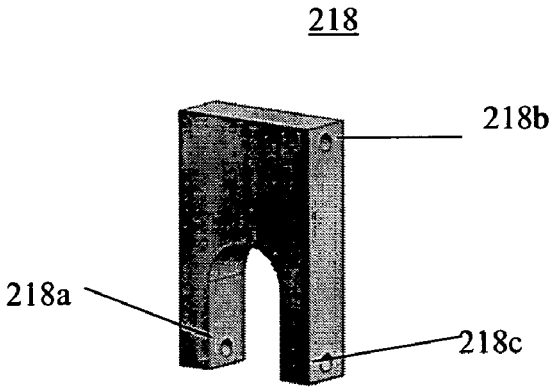
FIG. 18 shows an isometric perspective view of the bracket 218 in accordance with one embodiment of the present invention.

FIG. 18 shows an isometric perspective view of the bracket 218 in accordance with one embodiment of the present invention. The bracket 218 is configured to have a threaded hole 218*a* and a through hole 218*c* for cooperatively holding the backplate onto the frame 2, and a threaded hole 218*b* for securing the bracket to the backplate 211.

Figure 19:
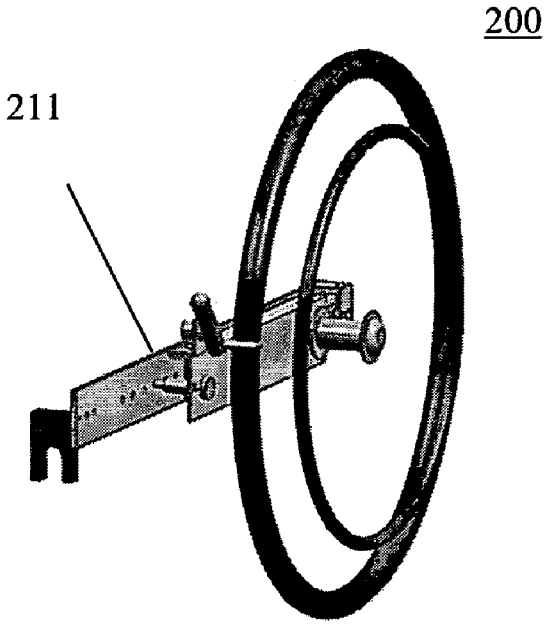
FIG. 19 shows an isometric perspective front view of the assembled modular wheel assembly 200 in accordance with one embodiment of the present invention.

FIG. 19 shows an isometric perspective front view of the assembled modular wheel assembly in accordance with one embodiment of the present invention. The modular wheel assembly 200 is in an extended position.

Figure 20:
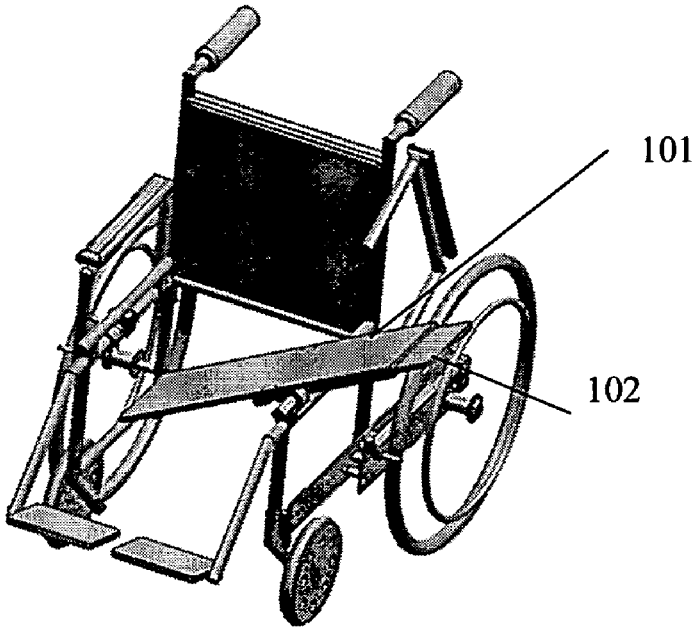
FIG. 20 shows an isometric perspective view of the wheelchair with the MLTA 100 in accordance with one embodiment of the present invention.
Figure 21:
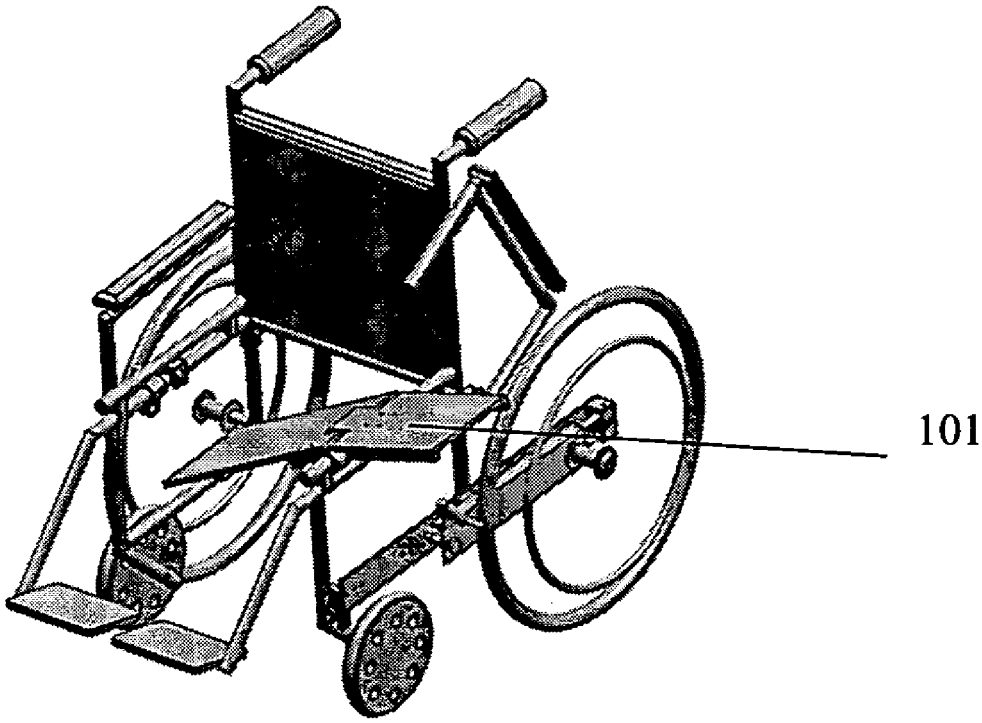
FIG. 21 shows an isometric perspective view of the wheelchair with the MLTA 100 in accordance with one embodiment of the present invention.

FIG. 20 shows an isometric perspective view of the wheelchair in accordance with one embodiment of the present invention. The wheelchair transfer apparatus is in a semi-deployed position with the sling seat removed for visual clarity. The modular lateral transfer assembly 100 has a main slide board 101 with a one-piece configuration. FIG. 21 shows another main slide board 101 with a two-piece configuration. In both configurations, the use of the secondary slide board is contemplated.

Figure 22:
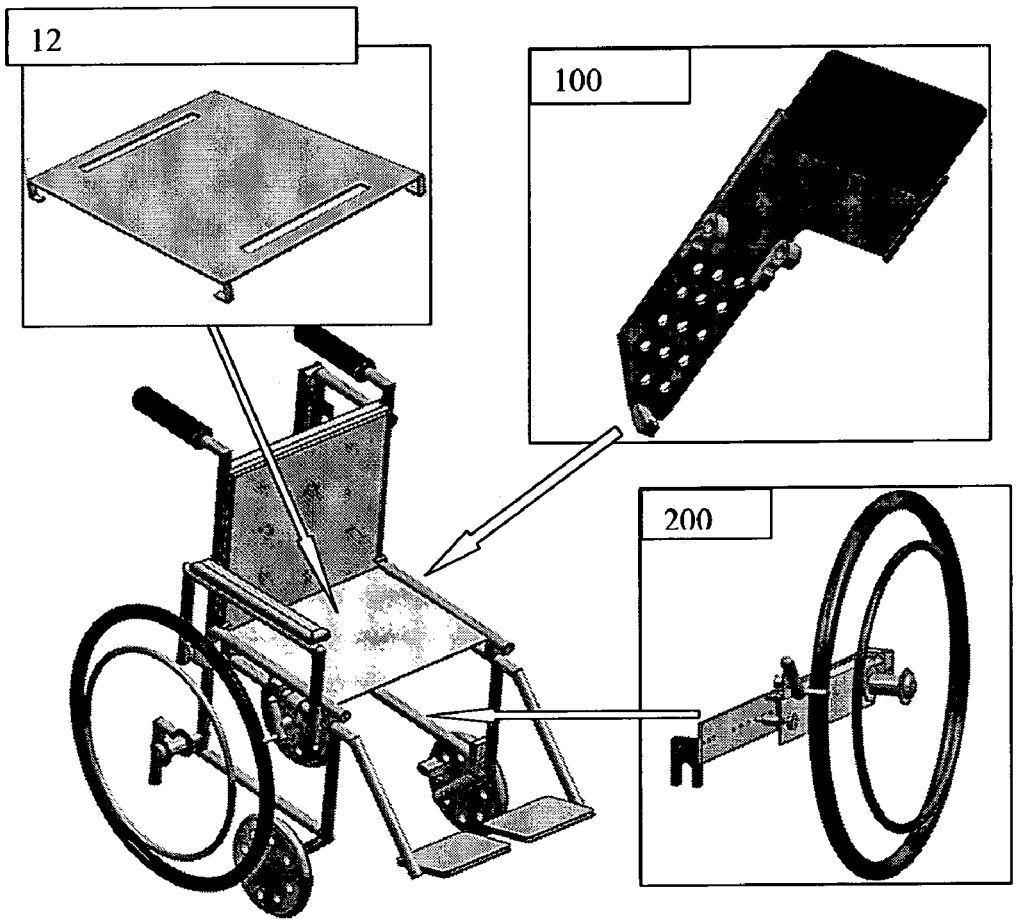
FIG. 22 shows an exploded view of the wheelchair in accordance with one embodiment of the present invention.

FIG. 22 shows an exploded view of the wheelchair in accordance with one embodiment of the present invention.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A modular lateral transfer assembly (MLTA) adaptable to a wheelchair for easily transferring a wheelchair bound person, comprising:

a pivotal shaft being secured onto a frame of the wheelchair, for providing physical support for the MLTA;

a main slide board for providing a transfer plane;

one or more sleeve units disposed underneath of the main slide board for securing the board onto the pivotal shaft; and a location hole assembly disposed at one end of the main slide board; thereby when the main slide board via the location hole assembly is secured to the frame of the wheelchair, the wheelchair bound person can be laterally transferred via the transfer plane.

2. The MLTA of claim 1, wherein the main slide board has a plurality of through holes for lightening the board.

3. The MLTA of claim 1, further comprising a secondary slide board, wherein the main slide board has one end for receiving the secondary slide board so that when the secondary slide board is pulled out, it forms an elongated transfer plane.

4. The MLTA of claim 1, wherein each sleeve unit has a channel allowing the sleeve unit to rotatably accommodate the frame and a threaded hole for accommodating a fastener for securing the sleeve unit onto the main slide board.

5. The MLTA of claim 1, wherein the location hole assembly has an oversized cavity for receiving a quick-release locking means disposed onto the opposite side of the frame, so that the main slide board is ready for transfer.

6. The MLTA of claim 1, wherein the main slide board comprises one or more casing disposed onto its top surface for receiving one or more rollers, easing the transfer process.

7. The MLTA of claim 1, where the main slide board comprises a plurality of casings disposed onto its top surface for receiving a plurality of rolling balls, easing the transfer process.

8. The MLTA of claim 1, wherein the main slide board has a one-piece configuration.

9. The MLTA of claim 1, wherein the main slide board has a two-piece configuration.

10. A modular wheel assembly (MWA) adaptable to a wheelchair for easily transferring a wheelchair bound person laterally, comprising:

a linear guide assembly being removably disposed onto a frame of the wheelchair;

wherein the linear guide assembly comprises:

a backplate being removably coupled with the frame of the wheelchair;

a pair of linear guide rods;

a pair of linear guide holding blocks securely coupled onto the back late for holding the two ends of the linear guide rods;

a linear slide unit slidably disposed on the linear guide rods so that the linear slide unit moves between the linear guide holding blocks; and means for securely coupling the linear guide assembly to the frame via the backplate;

a slidable wheel assembly coupled with the linear slide unit of the linear guide assembly, whereby the slidable wheel assembly slides along the pair of linear guide rods of the linear guide assembly between the two ends of the linear guide rods; and a quick-release locator working together with the linear guide assembly to secure and lock the slidable wheel assembly at a desired position;

whereby when the slidable wheel assembly is moved away from the front to the rear of the frame, a lateral transfer is allowed.

11. The MWA of claim 10, wherein the slidable wheel assembly comprises:

a wheel;

a wheel axle for supporting the wheel;

a cover plate;

a wheel lock/brake mounted on the cover plate for locking the wheel when it is not in motion;

the quick-release locator mounted on the cover plate for securing the slidable wheel assembly at a desired position; and a hand rim for allowing hand pushes.

12. The MWA of claim 10, wherein the means for securely coupling the linear guide assembly to the frame comprises a bracket.

13. The MWA of claim 10, wherein the backplate has a plurality of holes including home location holes, alternate home location holes and transfer location holes for stopping and securing the motion of the linear slide unit.

14. The MWA of claim 10, wherein the linear guide assembly further comprises a cover plate for covering the linear guide assembly.

15. The MWA of claim 10, wherein the linear slide unit is preloaded with rolling elements for easy sliding.

16. The MWA of claim 10, wherein the linear guide rods have a feature selected from the group consisting of spline, circular shaft, polygonal shaft, and track rail.

17. The MWA of claim 10, wherein the linear guide rod holding block is configured to have a pair of holes for receiving the linear guide rods, a pair of holes for fastening the block onto the backplate, and a hole for receiving a fastener for locking the linear guide rods.

18. The MWA of claim 10, wherein the bracket is configured to have a threaded hole and a through hole for cooperatively holding the backplate onto the frame, and a threaded hole for securing the bracket to the backplate.

19. A wheelchair for easily transferring a wheelchair bound person, comprising:

a modular lateral transfer assembly (MLTA), where the MLTA comprises:

a pivotal shaft being secured onto a frame of the wheelchair, thereby providing physical support for the MLTA;

a main slide board for providing a transfer plane;

one or more sleeve units disposed underneath of the main slide board for securing the board onto the pivotal shaft; and a location hole assembly disposed at one end of the main slide board;

thereby when the main slide board via the location hole assembly is secured to the frame of the wheelchair, the wheelchair bound person can be laterally transferred via the transfer plane; and a quick-release locking means for locking/unlocking the main slide board when it is being used for transfer.

20. The wheelchair of claim 19, wherein the quick-release locking means is a spring loaded plunger.

21. The wheelchair of claim 19, further comprising a seat cover disposed on top of a sling seat and detachable from the sling seat.

22. A wheelchair for easily transferring a wheelchair bound person, comprising:

a frame; and a modular wheel assembly (MWA), comprising:

a linear guide assembly being removably disposed onto a frame of the wheelchair; wherein the linear guide assembly comprises:

a backplate being removably coupled with the frame of the wheelchair;

a pair of linear guide rods;

a pair of linear guide holding blocks securely coupled onto the backplate for holding the two ends of the linear guide rods;

a linear slide unit slidably disposed on the linear guide rods so that the linear slide unit moves between the linear guide holding blocks; and means for securely coupling the linear guide assembly to the frame via the backplate;

a slidable wheel assembly coupled with the linear slide unit of the linear guide assembly, whereby the slidable wheel assembly slides along the pair of linear guide rods of the linear guide assembly between the two ends of the linear guide rods; and a quick-release locator working together with the linear guide assembly to secure and lock the slidable wheel assembly at a desired position;

whereby when the slidable wheel assembly is moved away from the front to the rear of the frame, a lateral transfer is allowed.

23. The wheelchair of claim 22, further comprising a modular lateral transfer assembly (MLTA), where the MLTA comprises:

a pivotal shaft being secured onto a frame of the wheelchair, thereby providing physical support for the MLTA;

a main slide board for providing a transfer plane;

one or more sleeve units disposed underneath of the main slide board for securing the board onto the pivotal shaft; and a location hole assembly disposed at one end of the main slide board; thereby when the main slide hoard via the location hole assembly is secured to the frame of the wheelchair, the wheelchair bound person is transferred via the transfer plane.

24. The wheelchair of claim 23, further comprising a quick-release locking means for locking/unlocking the main slide board when it is being used for transfer.

25. The wheelchair of claim 24, wherein the quick-release locking means is a spring loaded plunger.

26. The wheelchair of claim 22, further comprising a seat cover disposed on top of a sling seat and detachable from the sling seat.

* * * * *